United States Patent [19]

Sekiguchi

[11] 4,401,006

[45] Aug. 30, 1983

[54] MUSIC BOX SPRING WINDING MECHANISM

[76] Inventor: Takeshi Sekiguchi, No. 3-101, Takahama-cho, Takahagi-City, Ibaragi-ken, Japan

[21] Appl. No.: 290,115

[22] Filed: Aug. 5, 1981

[51] Int. Cl.[3] ..... G10F 1/06

[52] U.S. Cl. ..... 84/95 R; 74/577 M; 74/577 SF; 192/46

[58] Field of Search ..... 74/577 M, 577 SF; 84/94-96; 368/140, 145, 147, 154, 206; 192/46

[56] References Cited

U.S. PATENT DOCUMENTS 40,086 9/1863 Taylor ..... 74/577 M 3,390,599 7/1968 Komatsu ..... 84/96

FOREIGN PATENT DOCUMENTS 1113355 5/1968 United Kingdom ..... 84/95

*Primary Examiner*—Lawrence R. Franklin

*Attorney, Agent, or Firm*—Edwin E. Greigg

[57] ABSTRACT

The invention is directed to a music box spring drive mechanism comprising a wheel that has a bevel gear on an outer peripheral edge with an inner recess that has ratchet teeth on its peripheral wall of the recess, a spring winding axle cooperates with the wheel to provide a drive for a music making cylinder. A pawl member is centrally located in the recess of the wheel and cooperates with the ratchet teeth to drive the wheel. The pawl comprises a body portion having a thickness corresponding to the depth of the recess, a resilient arcuated portion integrally formed with the body portion with teeth formed on the end of the arcuated portion. The teeth are provided with a first contact portion and a second contact portion which are in contact with a ratchet tooth formed along the inner wall of the recess.

3 Claims, 6 Drawing Figures

MUSIC BOX SPRING WINDING MECHANISM

BACKGROUND OF THE INVENTION

The present invention relates to a music producing device for music boxes and the like and, more particularly, to a coiled spring winding mechanism in combination with a drive wheel for use in a music producing device for music boxes and the like.

One example of the prior art coiled spring winding mechanism comprises a toothed wheel having a beveled gear provided along the periphery thereof and a recess portion provided in the center thereof, a ratchet tooth being formed on the flat portion of the recess, an outwardly displacable metallic engaging member fitted into the recess, and a coiled spring axle provided through the engaging member and the toothed wheel so that the engaging member is capable of cooperating with the coiled spring axle.

In connection with this device, following drawbacks are pointed out as follows:

One is that when transmitting a power, the engagement between the ratchet tooth and the engaging member becomes unstable because of difficulties in forming the toothed wheel, dimension error of the ratchet, and a trouble between the coiled spring axle and the engaging member. Second, the metallic engaging member will not engage the ratchet teeth if the toothed wheel moves in an axial direction away from the metallic engaging member with. respect to the coiled spring axle. Third is that, when the coiled spring axle revolves, the contacting sound occuring when the engaging member is in engagement with or out of engagement with the ratchet tooth, echoes in a casing for accommodating the coiled spring winding mechanism.

Another prior art device is disclosd in U.S.Pat. No. 3,390,599. This prior art teaches a music producing device for music boxes and the like having a two-part housing which has interconnecting walls grooved to provide bearings for the axles of the drum, driving spring, governer, and associated transmission gears, the drum having cylindrical bearing portions projecting less than the drum pins and being engaged by the two end reeds of the reed plate, and the music box having bevel gears transmitting the force from the driving spring to the drum.

SUMMARY OF THE INVENTION

One object of the present invention is to provide a coiled spring winding mechanism for use in a music producing device capable of eliminating an instability between a ratchet tooth formed in the recess of the toothed wheel and an engaging member.

Another object of the present invention is to provide a coiled spring winding mechanism for use in a music producing device capable of rotating a spring axle in a soft touch.

Another object of the present invention is to provide a coiled spring winding mechanism for use in a music producing device designed so that the sound of contact between the ratchet tooth and the toothed wheel does not echo in the box.

Another object of the present invention is to provide a coiled spring winding mechanism for use in a music producing device capable of quickly engaging the teeth on the pawl with the ratchet teeth so that the arcuated portion of the pawl is in contact with each end of the ratchet tooth, thereby making it possible to disperse the return pressure of the pawl.

Another object of the present invention is to provide a coiled spring winding mechanism for use in a music producing device which makes it easy to simplify the structure to facilitate the assembling thereof.

Another object of the present invention is to provide a coiled spring winding mechanism for use in a music producing device capable for producing a soft contacting sound when the pawl is in engagement with or out of engagement with the ratchet teeth.

BRIEF DESCRIPTION OF DRAWINGS

The features and advantages of the coiled spring winding mechanism for use in a music producing device according to the present invention will become more apparent from the following detailed description taken in conjunction with the accompanying drawings, in which.

In these drawings, the same reference numerals indicate the same or similar elements of the coiled spring winding mechanism according to the present invention.

DETAILED DESCRIPTION OF THE PREFERRED EMBODIMENT

Figure 1:
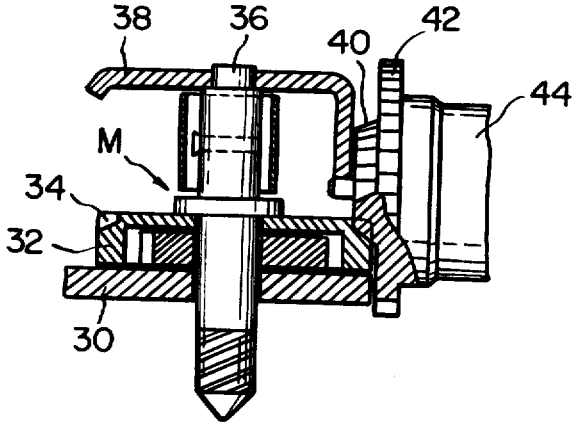
FIG. 1 is a schematic cross sectional and elevational view illustrating an one example of a music producing device.

FIG. 1 is a schematic cross sectional and elevational view illustrating an example of a music producing device.

As understood from FIG. 1, the music producing device includes a coiled spring winding mechanism labeled M. This mechanism M comprises a base member 30, a spring winding axle drive wheel 32 rotatably mounted on the base member 30, a bevel gear 34 formed on the outer peripheral edge of wheel 32, a spring loaded axle 36 extending through the bevel gear 34 and the wheel 32, the top of the spring axle being mounted on the casing 38. The music producing device further comprises a transmission mechanism comprising a bevel gear 40, a flat toothed wheel 42, and a drum 44.

The wheel 32 is provided with an axially aligned recess in which is disposed a pawl device **15*b*. The axle 36 extends through the wheel 32 and the pawl device and is keyed to the pawl device so that the pawl device will rotate with the spring winding axle. The upper end of the spring winding axle (14) near the end 36 is provided with a spring drive means. One end of the spring is secured to the housing and fixed against movement while the other end of the spring is secured to the axle so that the spring end moves with the axle as the axle is rotated. Rotation of the axle winds the spring to make the spring tight so that a motive force is formed in the spring. The pawl is provided with teeth (15***d*) on the outer end so that when the pawl is rotated with the axle to wind the spring, the teeth do not engage teeth (16) on the wheel 32. The teeth (15*d*) on the pawl function to lock against the teeth of wheel 32 so that after the spring is wound by the spring winding axle, the pawl teeth will engage one tooth of the wheel and rotate the wheel when the spring winding axle is released. The wheel 32 then drives bevel gear 40 to rotate the music cylinder.

The present invention is concerned with the coiled spring winding mechanism.

Before proceeding with the explanation of the invention, reference is made to the concerned conventional coiled spring mechanism.

Figure 2:
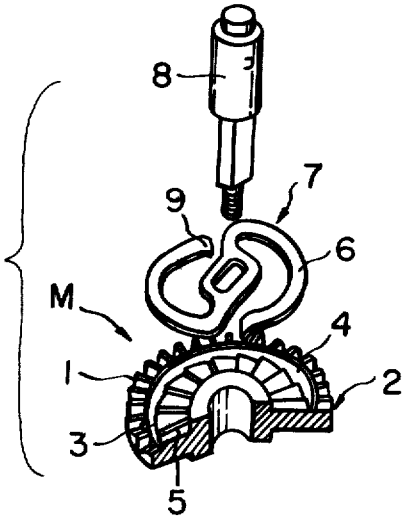
PRIOR ART FIG. 2
FIG. 2 is an exploded perspective view illustrating a conventional coiled spring winding mechanism.

In the prior art, a coiled spring winding mechanism, labeled by M, for use in a musich producing device, as shown in FIG. 2, comprises a spring winding axle wheel 2 with a bevel gear 1 wherein the wheel 2 is provided with an annular recess 3 close to the periphery of the spring toothed wheel 2. Reference numeral 4 designates an annular inner wall. The ratchet teeth 5 are formed on the flat portion of the recess 3. The engaging member 7 having a contact plate 6 is fitted into the recess 3 so as to become in contact with the inner peripheral surface 4. The contact plate is capable of cooperating with a spring winding axle 8.

According to this construction, the pawl portion 9 integrally formed with the top of the engaging member is in contact with the ratchet toothed wheel 5 in the axial direction. It is required that the pressure of the pawl portion 9 of the engaging member 7 is exerted on the ratchet wheel 5.

In this case, the following drawbacks are pointed out.

That is, when transmitting a power, the engagement or disengagement between the ratchet tooth 5 and the engaging member 7 becomes unstable because of failure in the springforces required to press the engaging member against the ratchet teeth on wheel 2. Dimension error, such as thickness of the ratchet wheel 5, and an inconvenience occuring when the spring axle 8 is assembled into the engaging member are other drawbacks.

Further, a following disadvantage is pointed out; If wheel 2 is fixed to the spring axle 8 so that the wheel 2 cannot fluctuate in the axial direction with respect to the spring axle 8, it is difficult that the wheel 2 cannot smoothly mesh with the drum toothed wheel (not shown in FIG. 2). Furthermore, since the recess 3 is formed on the upper portion of the wheel 2, when the spring toothed engaging member 7 starts to revolve, the contacting sound of the pawl portion 9 of the engaging member 7 which is engaged with or out of engagement with the ratchet wheel 5 echoes in a casing (not shown). Since the engaging member 7 is formed with metal and the pawl portion 9 of the engaging member 7 is engaged with or out of engagement with the ratchet tooth 5 by one pitch, the revolution of the toothed wheel 8 cannot be smoothly effected. Thus, rotation action of the engaging member 7 is impressed to be heavy.

Moreover, in effecting such rotating action, there occurs hard sound, occuring when the metallic material strikes any material.

Reference is now made to the present invention.

The preferred embodiments according to the present invention will be explained with reference to the drawings.

Figure 3:
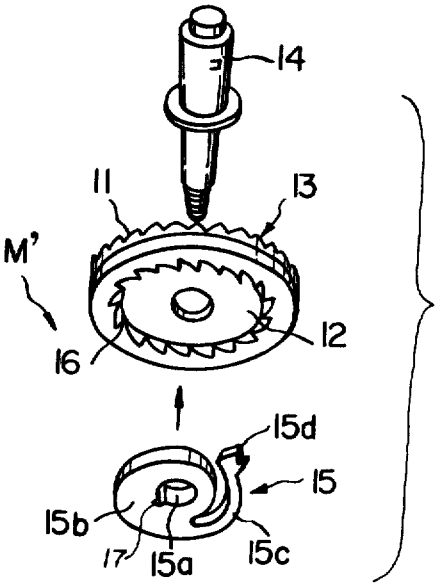
FIG. 3 is an exploded perspective view illustrating a coiled spring winding mechanism according to the present invention.
Figure 4:
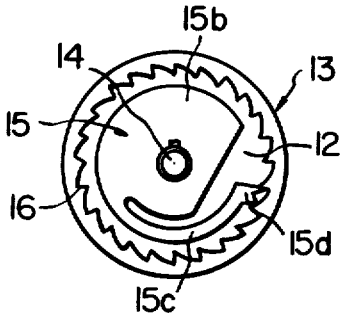
FIG. 4 is a view illustrating the pawl assembly and ratchet teeth on the drive wheel of the invention.
Figure 5:
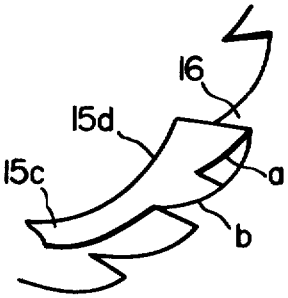
FIG. 5 is a schematic view illustrating an engagement relationship between an engaging member and ratchet teeth formed in a toothed wheel.
Figure 6:
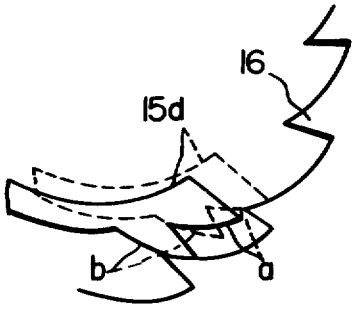
FIG. 6 is a view illustrating each condition that the fitting portion of the engaging member is in engagement with or out of engagement with the ratchet tooth as shown in FIG. 5.

In the embodiment shown in FIGS. 3 to 6, M′ designates a spring winding mechanism for use in a music producing device. The spring winding mechanism M′ comprises a ratchet drive wheel 13 having a bevel gear 11 formed along the periphery of the outer edge of the upper surface thereof and a recess 12 formed in the lower surface thereof, and pawl member 15 of synthetic resin which is fitted in the recess 12 and is adapted to cooperate with the spring winding axle 14. The ratchet wheel has teeth 16 formed along the inner peripheral surface of the recess 12. As shown in FIG. 3 the pawl member 15 comprises a body portion 15*b* having a central aperture 15*a* through which the spring winding axle 14 is fitted and secured thereto against rotation by a key that fits into a key-way 17, a resilient arcuated portion 15*c* integrally formed with the body portion 15*b*, and a portion 15*d* formed on the end of the arcuated portion 15*c*. The portion 15*d*, as shown in FIGS. 5 and 6, comprises a first contact portion a and a second contact portion b so that they are capable of being in contact with the ratchet tooth 16 when the pawl member 15 revolves together with the spring winding axle 14. The portion is made of synthetic resin. In this case, the thickness of the portion 15*d* is that of the recess 12 in order that the gap. between the recess 12 of the wheel 13 and the pawl member becomes small, as minimum as possible, in order to render the suitable strength. The angle of the ratchet teeth 16 formed along the inner peripheral surface of the recess 12 is about 90° with respect to the spring axle 14.

Reference is made to the operation of this mechanism. Assuming that the spring tooth wheel 13 and the pawl member 15 are placed on the base member shown in FIG. 1. When the spring winding axle 14 revolves, the spring is wounded so that the arcuated portion 15*c* of the pawl member 15 is displaced inwardly because of the resilient force.

As understood from the engagement state shown in FIG. 5 to the out of engagement state shown in FIG. 6, when the engagement of the second contact portion b of the fitting portion 15*d* is released, under the condition that the fitting portion 15*d* is floated, the first contact portion a comes in contact with the top of the tooth of the ratchet tooth 16. Then, when starting to rotate, the contact condition of the first contact portion a is released. The fitting portion 15*d* becomes in contact with the adjacent portion of the second contact b. When the fitting portion 15*d* revolves, under the condition that the fitting portion 15*d* is placed in a floating condition the second contact portion b is in contact with the top of the adjacent tooth. When the revolution of the spring winding axle 14 is stopped, the fitting portion 15*d* is engaged with the ratchet tooth 16 as shown in FIG. 4, thereby preventing the axle 14 to be rotated in the opposite direction. Because returning force is applied to the arcuated portion 15*c* of the engaging member 15, the arcuated portion 15*c* is formed so that its width is enlarged.

Thus, the same action is repeated. That is, the fitting portion 15*d* rotates while resiliently contacting the top of the tooth of the ratchet wheel 16 by ½ pitch.

While this invention has been described in conjunction with specific embodiments thereof, it is evident that many alternatives, modifications and variations will be apparent to those skilled in the art. Accordingly, it is intented to embrace all alternatives, modifications and variations that fail within the spirit and broad scope of the appended claims.

What is claimed is:

1. A music box spring drive mechanism comprising: a wheel including a lower surface and an upper surface, a recess having an inner peripheral wall found in said lower surface, said recess having ratchet teeth formed along the inner peripheral wall, said upper surface including a peripheral edge having a bevel gear formed therealong;

a spring winding axle having one end of a spring connected thereto, the other end of said spring being connected to a fixed portion of said music box; and a pawl member located within said pawl member having a body portion connection to said axle rotation therewith, a resilient arcuate pawl portion formed integrally with said body portion, said pawl portion having teeth means thereon for engagement with said ratchet teeth.

2. A music box spring drive mechanism as defined in claim 1, wherein said teeth means is provided with a first contacting portion and a second contacting end portion so that said contacting portions are in contact with said ratchet teeth in a floating condition, respectively.

3. A music box spring drive mechanism as defined in claim 1 or 2, wherein said pawl member is made of synthetic resin, and said first and second contacting portions have a width corresponding to the depth of the recess of said wheel.

* * * * *